US009147569B2

(12) United States Patent
Magg et al.

(10) Patent No.: US 9,147,569 B2
(45) Date of Patent: Sep. 29, 2015

(54) ELECTRODE, AND HIGH-PRESSURE DISCHARGE LAMP COMPRISING SAID ELECTRODE

(75) Inventors: Norbert Magg, Berlin (DE); Simon Lankes, Falkensee (DE); Peter Flesch, Berlin (DE); Andre Nauen, Regensburg (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/130,281

(22) PCT Filed: May 8, 2012

(86) PCT No.: PCT/EP2012/058467

§ 371 (c)(1),
(2), (4) Date: Dec. 30, 2013

(87) PCT Pub. No.: WO2013/000613

PCT Pub. Date: Jan. 3, 2013

(65) Prior Publication Data

US 2014/0125223 A1 May 8, 2014

(30) Foreign Application Priority Data

Jun. 30, 2011 (DE) ..... 10 2011 078 472

(51) Int. Cl.
*H01J 1/62* (2006.01)
*H01J 61/073* (2006.01)
*H01J 61/86* (2006.01)

(52) U.S. Cl.
CPC ..... *H01J 61/0732* (2013.01); *H01J 61/86* (2013.01)

(58) Field of Classification Search
CPC ..... H01J 61/0732; H01J 61/86
USPC ..... 313/631, 357
See application file for complete search history.

(56) References Cited

U.S. PATENT DOCUMENTS

| | | | |
|---|---|---|---|
| 6,705,914 | B2 | 3/2004 | Tsutatani et al. |
| 2003/0042853 | A1 | 3/2003 | Yasuda et al. |
| 2005/0007023 | A1 | 1/2005 | Arimoto et al. |
| 2005/0099121 | A1 | 5/2005 | Kikuchi et al. |
| 2007/0132403 | A1 | 6/2007 | Goto et al. |

FOREIGN PATENT DOCUMENTS

| | | |
|---|---|---|
| CN | 1336783 | 2/2002 |
| CN | 101255973 | 9/2008 |
| DE | 10 31 421 | 6/1958 |
| EP | 2 337 060 | 6/2011 |
| JP | 2 174049 | 7/1990 |
| JP | 2007 317608 | 12/2007 |

*Primary Examiner* — Vip Patel
(74) *Attorney, Agent, or Firm* — Cozen O'Connor

(57) ABSTRACT

An electrode (1) for a high-pressure discharge lamp, having an electrode head (3) and an electrode rod (2), connected to electrode head (3) and defines a longitudinal axis (L). The electrode head (3) comprises a main section (4) on the same side as the electrode rod (2), an intermediate section (5) and an end section (9) on the opposite side from the electrode rod (2). The end surface of the end section (9) of the electrode head (3) is formed at least approximately semicircularly, and at least one subsection of the intermediate section (5) is cylindrically shaped. The extent (D2) of the cylindrical subsection of the intermediate section (5) in at least one direction perpendicular to the longitudinal axis is greater than the diameter (D3) of the semicircular end surface of the end section (9), but less than the largest transverse extent (D1) of the main section.

16 Claims, 7 Drawing Sheets

ELECTRODE, AND HIGH-PRESSURE DISCHARGE LAMP COMPRISING SAID ELECTRODE

RELATED APPLICATIONS

This application is a U.S. National Phase Application under 35 USC 371 of International Application PCT/EP2012/058467 filed May 8, 2012.

This application claims the priority of German application No. 10 2011 078 472.1 filed Jun. 30, 2011, the entire content of which is hereby incorporated by reference.

FIELD OF THE INVENTION

The invention relates to an electrode for a high-pressure discharge lamp and to a high-pressure discharge lamp having at least one such electrode. In particular, the invention also relates to a high-pressure short-arc discharge lamp for projection, effect lighting or endoscopy purposes, having at least one such electrode.

BACKGROUND OF THE INVENTION

High-pressure short-arc discharge lamps for projection purposes, in particular for video projection, are known for example from the company OSRAM under the name P-VIP®. In the case of such high-pressure discharge lamps, the electrodes are exposed to high thermal stresses and high currents, for example 4 amperes or more. Undesired electrode burn-back therefore occurs, electrode material on the electrode tip being evaporated, as well as likewise undesired migration of the electrode tips and consequently also of the discharge arc burning between the electrode tips. This migration of the electrode tip is represented very schematically in FIGS. 8*a* and 8*b*. FIG. 8*a* shows a highly simplified shape of an electrode 101 having an electrode rod 102 and an electrode head 103. The electrode head 103 comprises a circular-cylindrical main section 104, and a hemispherical end section 105 as the "electrode tip". The relatively bulky main section 104 is used primarily for thermal radiation and therefore preferably has a relatively large surface area in comparison with the much smaller end section 105 (also referred to below as an electrode tip for the sake of simplicity), which is primarily used for maximally optimal positioning of the discharge arc and stable burning behavior thereof without arc jumps. In the course of operation of AC lamps, however, it is found that the end section 105, which melts at least partially during the lamp operation, can migrate on the end surface 106 of the main section 104. This effect can be commensurately more significant when the difference between the diameter of the end surface 106 and the diameter of the hemispherical end section 105 is greater. FIG. 8*b* shows by way of example the way in which the hemispherical end section 105 has migrated as far as the upper edge of the end surface 106 of the main section 104. This migration of the electrode tip generally leads at most to a minor change in the electrode spacing, i.e. the spacing of the electrode tips lying opposite one another in the discharge vessel. Measurement of the electrode spacing-dependent lamp voltage therefore likewise shows scarcely any change. Nevertheless, this effect of the electrode tip migration can lead to a reduction of, for example, 30% in the projector light. The reason for this is as follows. Since discharge lamps for projection applications are operated in an optical reflector, the migration of the electrode tips, and consequently of the discharge arc, leads to a significant reduction in the optical system efficiency since the luminous discharge arc in this case migrates from the primary focus of the elliptical reflector. In applications which require coupling of the light into an optical aperture arranged at the secondary focus of the reflector, for example the aperture of a DLP™ (DLP=Digital light processing), LCD or LCOS chip, or an optical integrator or light guide, the input coupling efficiency thereby furthermore decreases. This disadvantageous effect becomes more pronounced with an increasing reflector eccentricity, or decreasing input aperture of the downstream optical projector system.

In practice, electrodes having a hemispherical or frustoconical electrode head are predominantly used in the case of video projection lamps. Electrodes of the former type (see for example US 2004/0155588 A1) have a comparatively large mass in the front region of the electrode head, so that the electrode tip becomes less hot and less electric material consequently evaporates. They therefore generally have advantages in relation to the electrode burn-back behavior. However, they offer a relatively large surface for the electrode tip migration, so that the advantage in the burn-back behavior is generally outweighed by the disadvantage of the increased electrode tip migration.

Electrodes having a frustoconical electrode head, on the other hand, ensure stabilization of the electrode tip position by their tapering shape. Owing to the lower mass in the vicinity of the electrode tips, however, they generally exhibit significantly faster electrode burn-back. Accordingly, attempts have been made in the past to find the best possible compromise between electrode burn-back and electrode tip migration for a specific electrode by varying the cone angle.

SUMMARY OF THE INVENTION

One object of the present invention is to eliminate the disadvantages mentioned above and to provide an electrode for high-pressure discharge lamps, in particular high-pressure short-arc discharge lamps for projection purposes, having a more stable operating behavior.

This object is achieved in accordance with one aspect of the invention directed to an electrode for a high-pressure discharge lamp, having an electrode head and an electrode rod, which is connected to the electrode head and defines a longitudinal axis, wherein the electrode head comprises a main section on the same side as the electrode rod, an intermediate section and an end section on the opposite side from the electrode rod, wherein the end surface of the end section of the electrode head is formed at least approximately semicircularly, and at least one subsection of the intermediate section is cylindrically shaped, wherein the extent of the cylindrical subsection of the intermediate section in at least one direction perpendicular to the longitudinal axis is greater than the diameter of the semicircular end surface of the end section, but less than the largest transverse extent of the main section.

For better understanding of the electrode geometry according to embodiments of the invention, it is expedient to define three sections for the electrode head - beginning with its end on the electrode side and ending with its "tip", i.e. along the longitudinal axis of the electrode - and specifically in this order a main section, an intermediate section and an end section. An advantage of such an electrode geometry, in particular the configuration of the intermediate region of the electrode head, is reduced electrode tip migration. To this end, the electrode head is configured in such a way that the end surface available for the electrode tip migration is spatially restricted. However, owing to the shaping of the electrode head, the mass in the immediate vicinity of the "electrode tip" differs only slightly from that in the case of a conventional hemispherical-head electrode so that the advantage of reduced electrode tip migration is not offset by an increased electrode burn-back behavior as is the case in the electrodes having frustoconically-shaped electrode heads. The aforementioned advantages are achieved according to embodiments of the invention by the intermediate section, which is cylindrical at least in a subsection and whose transverse extent, i.e. perpendicularly to the longitudinal axis of the electrode, is less in at least one direction, preferably in its entire scope, than the largest transverse extent of the main section, or of the rest of the body of the electrode head, in conjunction with the subsequent end section, the end surface of which is formed as an at least approximately hemispherical surface. This hemispherical end section, which is small relative to the cross-sectional area of the main section of the electrode head, functions as an "electrode tip" and, when a corresponding high-pressure discharge lamp is put into operation, facilitates positioning of the discharge arc on the two mutually opposite electrodes and flicker-free burning of the lamp. Owing to the smaller cross-sectional area in comparison with the main section, the intermediate section limits migration of the end section ("electrode tip") on its end surface. Nevertheless, the mass of the intermediate section in the immediate vicinity of the end section is sufficiently large in order to keep the burn-off of the end section small. To this end, the cylindrical subsection of the intermediate section preferably follows on directly from the end section. In this case, it has proven advantageous—in the case of an electrode which is rotationally symmetrical with respect to its longitudinal axis—for the ratio between the diameter of the aforementioned cylindrical subsection of the intermediate section and the largest diameter of the main section of the electrode head to lie in the range of from 0.2 to 0.9, preferably between 0.4 and 0.8. Furthermore, the transition between the intermediate section and the end section is preferably formed at a right angle, or at least approximately at a right angle, as seen in a plane containing the longitudinal axis. The hemispherically shaped end section then so-to-speak "sees" a plane end surface perpendicularly to the longitudinal axis, which limits its migrating movement since the discharge arc does not migrate out to the side beyond the right-angled edge of the intermediate section, as may be observed for example in the case of a frustoconical transition.

Advantageously, the electrode according to an embodiment of the invention may be made in one piece from a solid material, for example tungsten, for example by turning. In this case, the hemispherical "electrode tip" is preferably machined with it. As an alternative, such an "electrode tip" may also be formed in a controlled way by growth from a plane end surface, for example by means of pulsed operation during the so-called preburn of the discharge lamp, which is carried out once. In this case, a part of the electrode end surface is alternately liquefied and solidified in rapid succession, so that an at least approximately hemispherical "electrode tip" is gradually formed owing to the surface tension of the locally liquid electrode material.

The main section of the electrode head moreover need not necessarily consist of solid material, for example in the form of a circular cylinder. Rather, in order to increase the main section surface area which is crucial for the thermal radiation, an electrode coil wound thereon may also be provided. Further details may be found in the exemplary embodiments.

A high-pressure discharge lamp according to an embodiment of the invention has a discharge vessel, in which two electrodes are arranged opposite, and at least one of the two electrodes being an electrode according to an embodiment of the invention. In the case of a high-pressure discharge lamp according to an embodiment of the invention configured for alternating-current operation, both electrodes, which usually do not differ outwardly from one another, are preferably configured as an electrode according to an embodiment of the invention. In other words, in the case of a high-pressure discharge lamp according to an embodiment of the invention for AC operation, the two electrodes are identical to one another. Depending on the application, for example preferred use of the light spot in front of a particular electrode, or depending on the loading of the electrodes, for example by higher energy input by back reflections, the electrodes may also be optimized independently of one another and therefore be different even the case of AC lamps.

BRIEF DESCRIPTION OF THE DRAWINGS

The invention will be explained in more detail below with the aid of exemplary embodiments. In the figures.

DETAILED DESCRIPTION OF THE DRAWINGS

For features of the various figures which are the same or of the same type, the same references are used below.

Figure 1B:
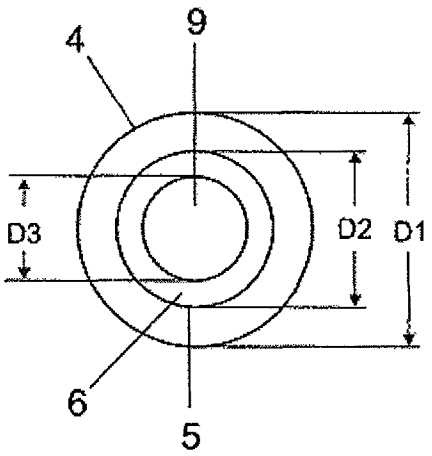
FIGS. 1*a, b* show a first embodiment of the electrode according to the invention having a circular-cylindrical main section, circular-cylindrical intermediate section and hemispherical end section.
Figure 1A:
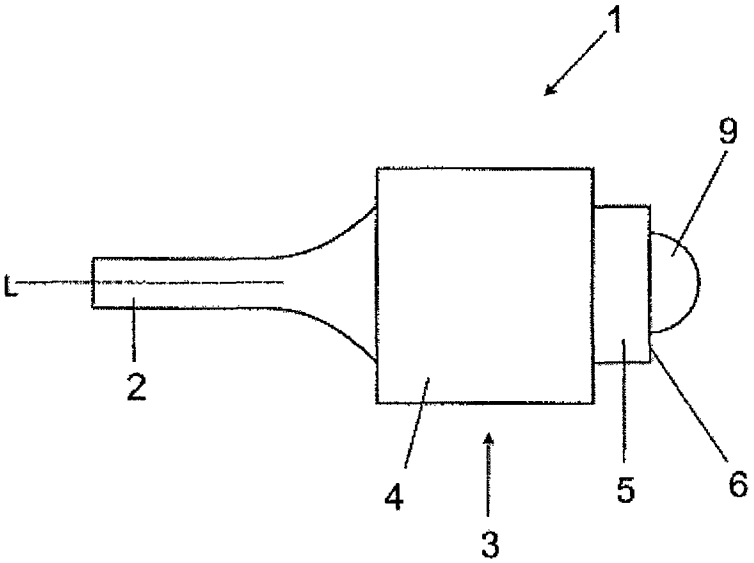

FIGS. 1*a* and 1*b* respectively show a side view and an end view of a first exemplary embodiment of an electrode 1 according to the invention. The electrode 1 consists of an electrode rod 2 and an electrode head 3, by means of which a longitudinal axis L is defined. The electrode head 3 comprises a circular-cylindrical main section 4 (first section after the electrode rod 2), a likewise circular-cylindrical intermediate section 5 (second section) and a hemispherical end section 9 (third section). The main section 4 is used principally for thermal radiation, while the end section 9 is used primarily for maximally optimal positioning of the discharge arc. The intermediate section 5 is used inter alia for efficient dissipation of the heat of the discharge arc, which is positioned (not represented) on the hemispherical end section 9 and therefore reduction of the burn-back of the end section 9 (reduction of the electrode tip burn-back). Furthermore, the intermediate section 5 is also used to limit the migration of the hemispherical end section 9 ("electrode tip") on the flat end surface 6 of the intermediate section 5, i.e. the electrode tip migration. Specifically, the diameter D2 of the intermediate section 5 is less than the diameter D1 of the main section 4. In this way, the flat end surface 6 of the intermediate section 5 is smaller than the cross-sectional area of the main section 4. Furthermore, the diameter D3 of the hemispherical end section 9 is less than the diameter D2 of the intermediate section 5. Therefore, as seen perpendicularly to the longitudinal axis L, a right-angled edge is formed by the intermediate section 5 at the transition to the hemispherical end section 9. Consequently, the migration of the hemispherical end section 9 on the flat end surface 6 of the intermediate section 5 is correspondingly spatially restricted. The electrode 1 is preferably turned from solid material, that is to say in one piece. In particular, pure tungsten may be envisioned as the material.

Figure 2B:
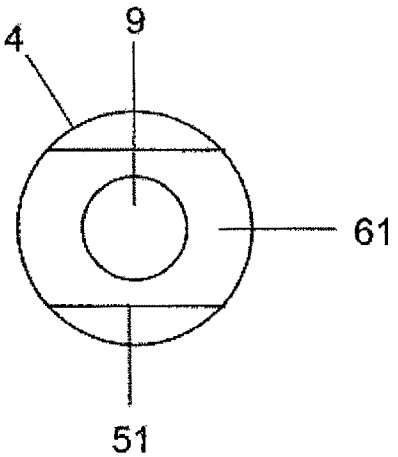
FIGS. 2*a, b* show a variant of the embodiment of FIGS. 1*a*, 1*b*, having a rotationally non-symmetrical cylindrical intermediate section.
Figure 2A:
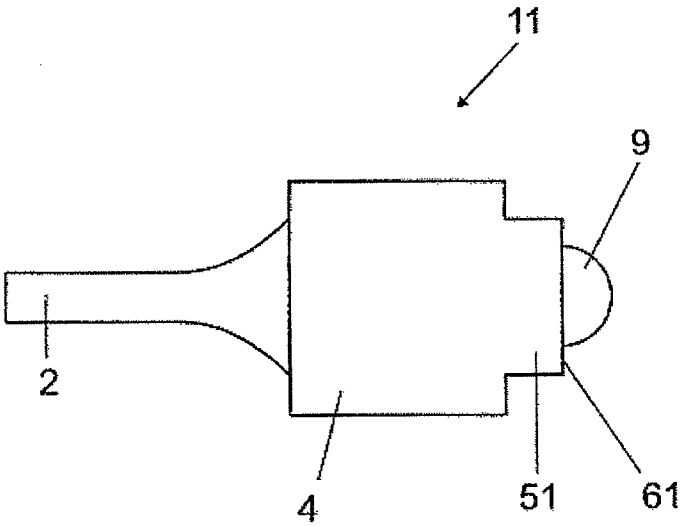

FIGS. 2*a*, 2*b* show a variant 11 of the electrode represented in FIGS. 1*a, b*. It differs merely by the not circular-cylindrical but cylindrical intermediate section 51 with an elongate end surface 61. Owing to the absence of rotational symmetry of the intermediate section 51, the migration of the hemispherical end section 9 ("electrode tip migration") is maximally restricted only in a transverse direction. In the direction perpendicular thereto, conversely, the end surface 61 extends over the full electrode head diameter. This has advantages when the electrode tip migration has a preferential direction (for example along the convection direction). A disadvantage with this, however, is that a defined installation position of the electrode 11 must be ensured during the lamp production.

Figure 3:
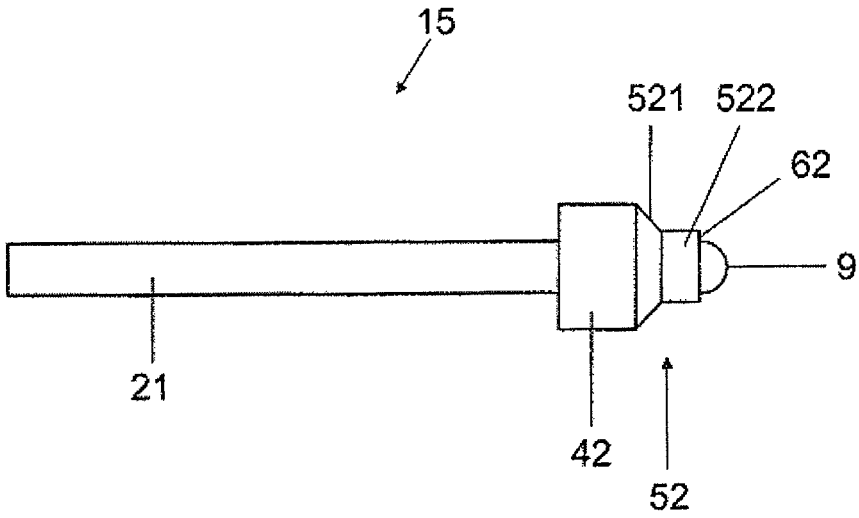
FIG. 3 shows a further variant of the embodiment of FIGS. 1*a*, 1*b*, having an intermediate section which comprises a conical subsection and a circular-cylindrical subsection.

FIG. 3 shows a further embodiment of an electrode 15 according to the invention. The main section 42 following on from the electrode rod 21 is configured circular-cylindrically. The intermediate section 52, conversely, consists of a conical subsection 521 and a circular-cylindrical subsection 522. The hemispherical end section 9 ("electrode tip") follows on at the end of the circular-cylindrical subsection 522. This exemplary embodiment illustrates that the transition between the main section 42 and the end section 9 need not necessarily form a step which is right-angled in profile, as shown in FIG. 1. Rather, differently shaped transitions may also be envisioned without losing the advantages according to the invention. What is crucial is that the intermediate section 52 forming this transition on the one hand has an end surface 62 whose diameter is less than that of the main section 42, but on the other hand has sufficient mass in the immediate proximity of the end section 9. The circular-cylindrical subsection 522 immediately next to the end section 9 satisfied these two conditions. In this regard, the embodiment shown in FIG. 3 does not differ from that shown in FIGS. 1*a*, 1*b*. The conical subsection 521 further away, however, has primarily configurational purposes.

Figure 4:
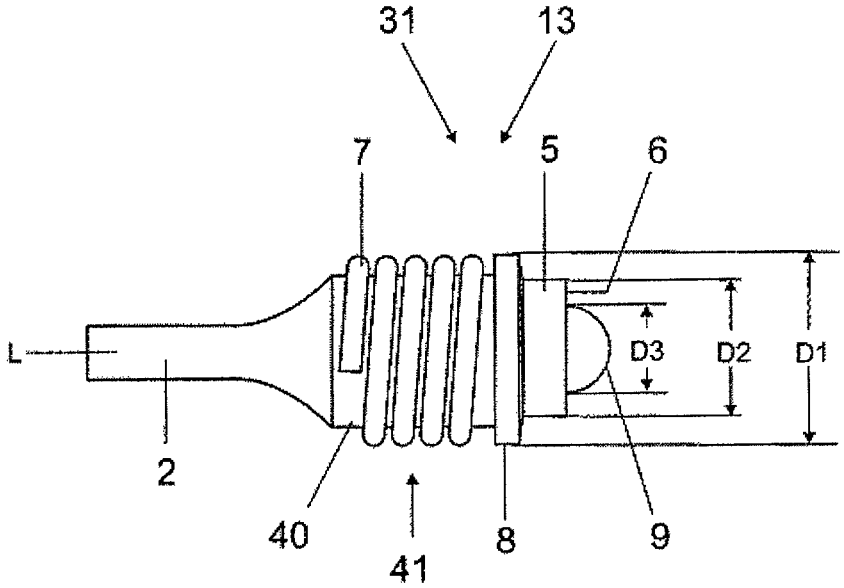
FIG. 4 shows a variant of the embodiment of FIGS. 1*a*, 1*b*, having a main section which comprises an electrode coil.
Figure 5:
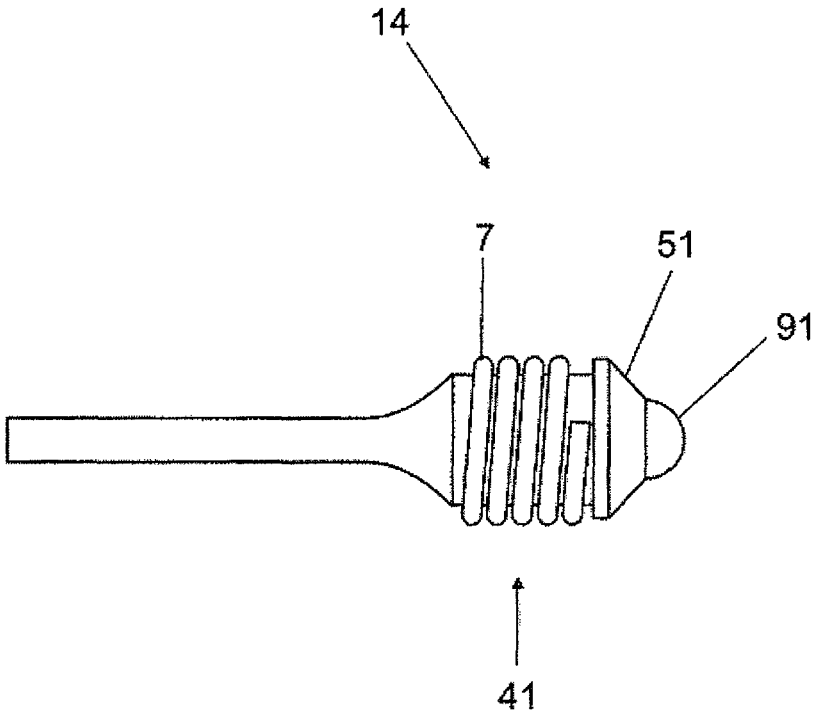
FIG 5 (Prior Art)
FIG. 5 shows a conventional electrode for high-pressure short-arc discharge lamps for video projection.

FIG. 4 shows a further embodiment of an electrode 13. In contrast to the variant represented in FIGS. 1*a*, 1*b*, in this case the main section 41 comprises an electrode coil 7 which is pushed onto the circular-cylindrical base body 40 of the main section 41 in the direction of the longitudinal axis L. Furthermore, the main section 41 is provided with an annular bead 8 which prevents the electrode coil 7 from slipping in the direction toward the circular-cylindrical intermediate section 5. This variant has the advantage that, owing to the electrode coil 7, a surface area increase is achieved with a comparably large outer diameter of the main section 41 (diameter of an imaginary envelope cylinder) and consequently improved thermal radiation relative to the volume. A comparable effect can be achieved by suitable structuring of the surface of the main section 4 in FIG. 1*a*, for example a spiral groove or the like (not represented). The diameter D2 of the end surface 6 of the intermediate section 5 is 1.3 mm. The largest diameter D1 of the main section 41, which in this case corresponds to the diameter of the annular bead 8, is 1.8 mm. This results in a diameter ratio D2/D1 of about 0.7. Preferably, the diameter ratio D2/D1 lies in the range of from 0.2 to 0.9, particularly preferably in the range of from 0.4 to 0.8. The diameter D3 of the hemispherical end section 9 is 0.8 mm, and is therefore smaller than both the diameter D1 of the main section 41 and the diameter D2 of the end surface 6 of the intermediate section 5. In other regards, the electrode 13 has the same maximum dimensions (overall length 7.5 mm; maximum outer diameter 1.8 mm) as an electrode 14 as represented in FIG. 5, which is currently used for example for the video projection lamp P-VIP 330/1.0 E20.9. The electrode head of the conventional electrode 14 comprises a frustoconical intermediate section 51, which ends without a right-angled intermediate step in a hemispherical section 91. This geometry is merely an, inferior compromise, compared with the invention, between electrode burn-back and electrode tip migration.

Figure 6:
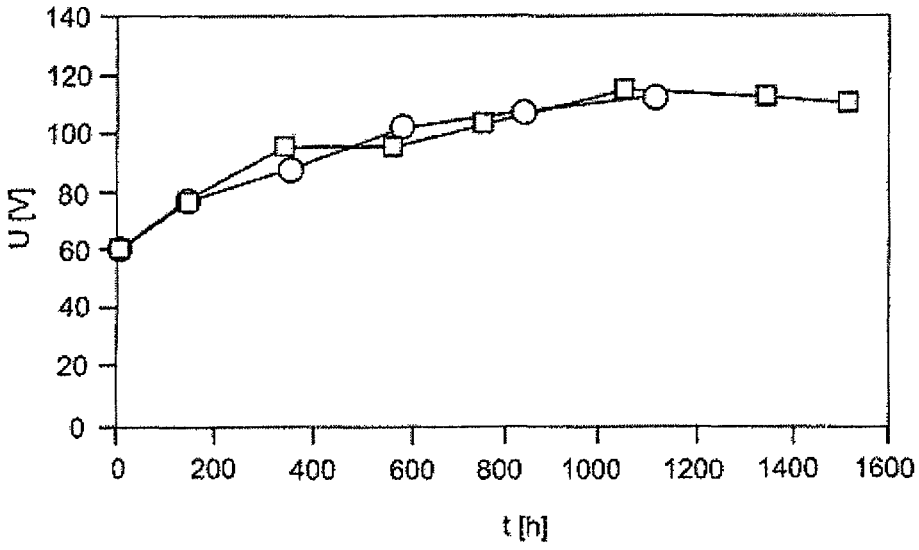
FIG. 6 shows a comparison of the profile of the averaged electrode voltages as a function of time, respectively of a group of six discharge lamps having electrodes according to the invention or conventional electrodes.
Figure 7:
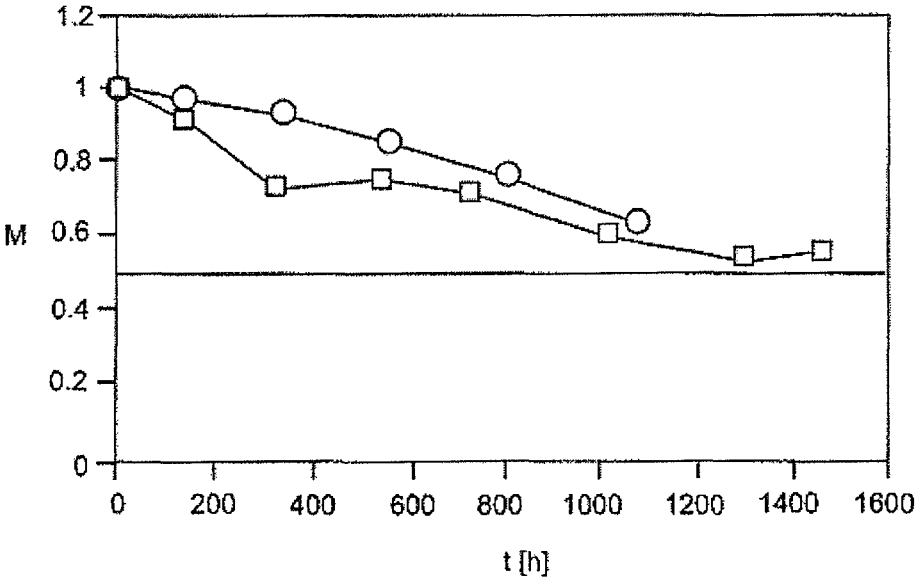
FIG. 7 shows a comparison of the maintenance respectively of a group of six discharge lamps having electrodes according to embodiments of the invention or conventional electrodes.
Figure 8A:
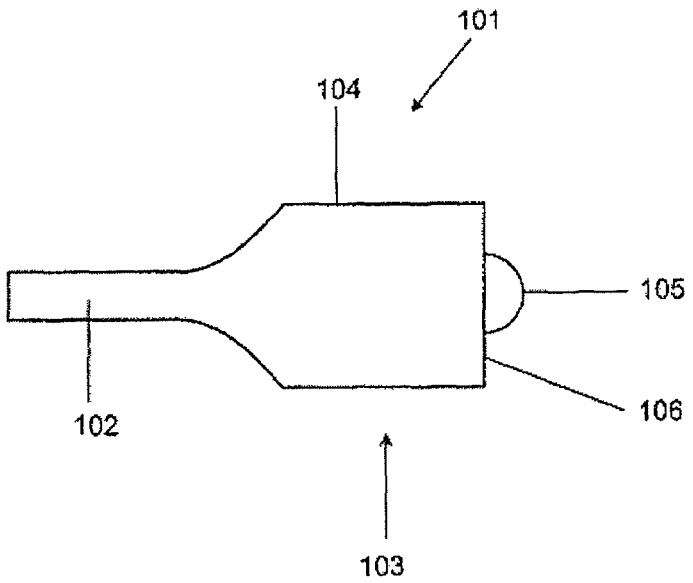
FIGS. 8*a, b* show a schematic representation of two conventional electrodes in order to illustrate the electrode tip migration.
Figure 8B:
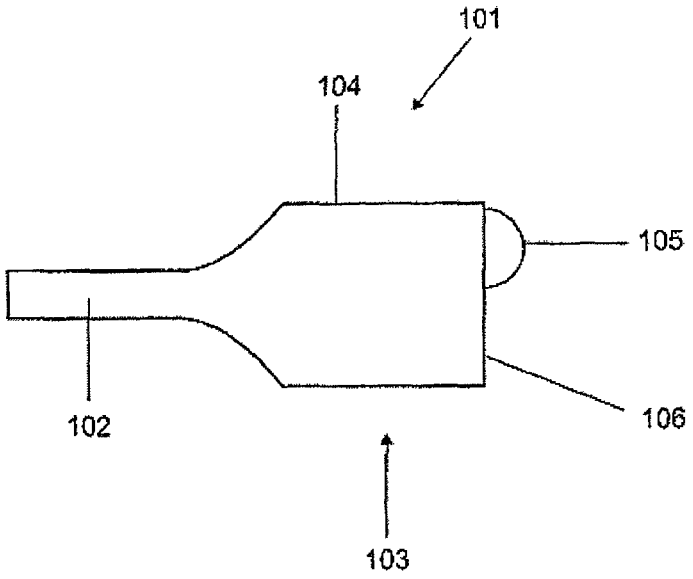
FIG 8b (Prior Art)

In FIGS. 6 and 7, mass values respectively of a group of six discharge lamps of the type OSRAM P-VIP® 330/1.0 E20.9 (video projection lamps) having electrodes according to the invention (circles) according to FIG. 4 or conventional electrodes (squares) according to FIG. 5 are graphically represented in comparison. In FIG. 6, the electrode voltage U (Y axis) is plotted against time t (=burning time of the lamp; X axis). In FIG. 7, the so-called maintenance M, which is the light flux (Y axis) measured in the visible range through a 6 mm circular aperture with a V(λ) filter, is plotted against time t (=burning time of the lamp; X axis). According thereto, the electrode according to the invention shows no significant difference in burn-back behavior (see voltage curve in FIG. 6; the electrode voltage correlates with the electrode spacing), but conversely significantly less electrode tip migration (slower downward slope of the maintenance curve).

Figure 9:
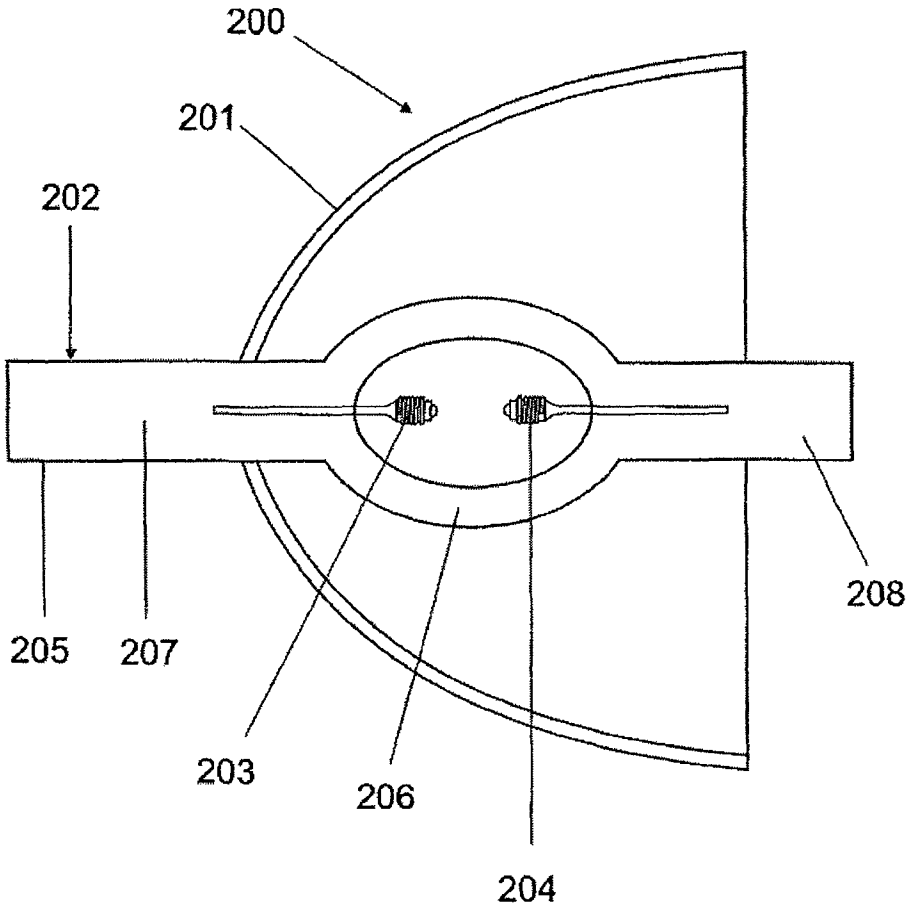
FIG. 9 shows a high-pressure short-arc discharge lamp according to an embodiment of the invention for video projection.

FIG. 9 schematically shows an exemplary embodiment of a reflector lamp 200 according to the invention for projection purposes. The reflector lamp 200 consists of an elliptical reflector 201 and an elongate high-pressure short-arc discharge lamp 202. The latter is fastened with its end in the neck of the reflector 201, in such a way that it extends into the inside reflector 201 along the optical axis of the reflector 201. The high-pressure short-arc discharge lamp 202 is of the ultra-high-pressure mercury discharge lamp type and configured for alternating-current operation (AC). To this end, two identical electrodes 203, 204 of the embodiment represented in FIG. 4 are arranged with a mutual spacing (tip-to-tip) of 1 mm inside the discharge vessel 205 of the high-pressure short-arc discharge lamp 202. The discharge vessel 205 comprises an elliptical central section 206, which encloses the discharge gas, and two tubular end sections 207, 208, which are formed opposite one another on the central section 206. The two end sections 207, 208 support the two electrodes 203, 204. Furthermore, they each have a sealing region through which a gas-tight electrical conductor connected to the electrode rod extends outward (not represented). The reflector 201 and the high-pressure short-arc discharge lamp 202 are configured and adapted to one another in such a way that the discharge arc burning between the two electrodes 203, 204 during operation coincides as well as possible with the primary focus of the elliptical reflector 201.

An electrode with an electrode rod and an electrode head for a high-pressure discharge lamp is provided, having improved lifetime properties particularly in respect of burn-back and migration of the electrode tips. To this end, the electrode head comprises a main section on the same side as the electrode rod, an intermediate section and an end section on the opposite side from the electrode rod. Owing to the smaller diameter of the intermediate section in comparison with the diameter of the main section, the hemispherical end section ("electrode tip") is provided with a smaller end surface. In this way, the migration of the electrode tip is limited. The right-angled step transition from the end section to the larger intermediate section provides sufficient mass in the immediate vicinity of the end section in order to ensure good thermal dissipation from the end section ("electrode tip") to the intermediate section. In this way, the burn-back of the electrode tips is restricted.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. An electrode for a high-pressure discharge lamp, comprising:

an electrode head; and an electrode rod connected to the electrode head and defining a longitudinal axis, the electrode head comprising:

a main section on the same side as the electrode rod;

an end section on the opposite side from the electrode rod; and an intermediate section arranged between the end section and the main section;

wherein an end surface of the end section of the electrode head is formed at least approximately semicircularly, and at least one subsection of the intermediate section is cylindrically shaped; and wherein an extent of the cylindrical subsection of the intermediate section in at least one direction perpendicular to the longitudinal axis is greater than a diameter of a semicircular end surface of the end section, but less than a largest transverse extent of the main section.

2. The electrode as claimed in claim 1, wherein the cylindrically shaped subsection of the intermediate section directly adjoins the end section.

3. The electrode as claimed in claim 1, wherein at least the subsection of the intermediate section is circular-cylindrically shaped, and wherein the transverse extent thereof is the diameter of the circular-cylindrical subsection of the intermediate section.

4. The electrode as claimed in claim 1, wherein the main section is at least partially circular-cylindrically shaped, and wherein the largest transverse extent thereof is the largest diameter of the circular-cylindrical subsection of the intermediate section.

5. The electrode as claimed in claim 3, wherein the main section is at least partially circular-cylindrically shaped, and wherein the largest transverse extent thereof is the largest diameter of the circular-cylindrical subsection of the intermediate section 4, wherein the ratio between the diameter of the circular-cylindrical subsection of the intermediate section and the largest diameter of the main section lies in the range of between 0.2 and 0.9.

6. The electrode as claimed in claim 1, wherein the transition between the intermediate section and the end section is formed at a right angle as seen in a plane containing the longitudinal axis.

7. The electrode as claimed in claim 1, wherein the main section comprises a structure increasing its surface area.

8. The electrode as claimed in claim 1, wherein the electrode rod and the electrode head are formed in one piece.

9. The electrode as claimed in claim 1, wherein the electrode head consists of pure tungsten.

10. The electrode as claimed in claim 1, having an electrode coil which is arranged at least on a subsection of the main section of the electrode head.

11. The electrode as claimed in claim 10, wherein the main section is provided with an annular bead which prevents the electrode coil from slipping in the direction toward the circular-cylindrical intermediate section.

12. A high-pressure discharge lamp having a discharge vessel and having two electrodes arranged opposite, wherein at least one of the two electrodes is formed as claimed in claim 1.

13. A high-pressure discharge lamp having a discharge vessel and having two electrodes arranged opposite, which is configured for alternating-current operation and wherein each of said two electrodes is formed as claimed in claim 1.

14. The high-pressure discharge lamp as claimed in claim 12, for video or data projection purposes.

15. The high-pressure discharge lamp as claimed in claim 12, for endoscopy or effect lighting purposes.

16. The electrode as claimed in claim 3, wherein the main section is at least partially circular-cylindrically shaped, and wherein the largest transverse extent thereof is the largest diameter of the circular-cylindrical subsection of the intermediate section, wherein the ratio between the diameter of the circular-cylindrical subsection of the intermediate section and the largest diameter of the main section lies in the range of between 0.4 and 0.8.

* * * * *